US009168643B2

(12) United States Patent
Hsu et al.

(10) Patent No.: US 9,168,643 B2
(45) Date of Patent: Oct. 27, 2015

(54) DRIVING ROTATION TOOL

(71) Applicant: Yeo-Ming Wang, Taipei (TW)

(72) Inventors: Shih-Hao Hsu, Taipei (TW); Yeo-Ming Wang, Taipei (TW)

(73) Assignee: Yeo Ming Wang, Taipei (TW)

( * ) Notice: Subject to any disclaimer, the term of this patent is extended or adjusted under 35 U.S.C. 154(b) by 245 days.

(21) Appl. No.: 13/829,298

(22) Filed: Mar. 14, 2013

(65) Prior Publication Data

US 2013/0263701 A1 Oct. 10, 2013

(30) Foreign Application Priority Data

Apr. 10, 2012 (TW) ..... 101206516 U

(51) Int. Cl.
*B25B 13/06* (2006.01)

(52) U.S. Cl.
CPC ..... *B25B 13/065* (2013.01)

(58) Field of Classification Search
CPC ..... B25B 13/02; B25B 13/04; B25B 13/06; B25B 13/065
USPC ..... 81/121.1, 119, 186, 53.2
See application file for complete search history.

(56) References Cited

U.S. PATENT DOCUMENTS

| | | | | |
|---|---|---|---|---|
| 5,388,486 | A * | 2/1995 | Ruzicka et al. | 81/121.1 |
| 5,832,792 | A * | 11/1998 | Hsieh | 81/121.1 |
| 6,745,649 | B1 * | 6/2004 | Liao | 81/121.1 |
| 7,261,020 | B2 * | 8/2007 | Hsieh | 81/121.1 |
| 2008/0245195 | A1 | 10/2008 | Lee | |

FOREIGN PATENT DOCUMENTS

| | | |
|---|---|---|
| TW | M323375 | 12/2007 |

* cited by examiner

*Primary Examiner* — Hadi Shakeri
(74) *Attorney, Agent, or Firm* — Muncy, Geissler, Olds & Lowe, P.C.

(57) ABSTRACT

A driving rotation tool includes a socket base, a socket clearance hole inside the socket base and surrounded by three first gripping surfaces, three second gripping surfaces and six third gripping surfaces for development of edge planes around the socket clearance hole wherein the third gripping surface is located between the first gripping surface and the second gripping surface for circular permutation of first gripping surface, third gripping surface and second gripping surface. The first gripping surface is a cambered surface. The second gripping surface is an angled surface consisting of two adjoining planes which form an obtuse angle. As such, the tool facilitates not only normally driving a nut or a bolt head but also screwing or unscrewing the nut or the bolt head with edges or corners worn out or damaged and further promotes overall convenience, practicability and market competitiveness.

7 Claims, 7 Drawing Sheets

DRIVING ROTATION TOOL

BACKGROUND OF THE INVENTION

1. Field of the Invention

The present invention relates to a gyration tool, particularly a driving rotation tool used to screw or unscrew a workpiece worn out or damaged.

2. Description of the Related Art

A wrench as one tool to screw or unscrew a nut or a bolt head in regular work usually needs a socket, which is held in the wrench for occluding the nut (or the bolt head), and is turned to drive the socket as well as the nut or the bolt head for completion of screwing or unscrewing. In this regard, a relative slip is common in the socket in which the nut or the bolt head with some edges or corners worn out or damaged after long-term usage is held and leads to failure of screwing or unscrewing the nut or the bolt head. Accordingly, a technology as shown in FIG. 1 features a socket 90 with a coupling hole 91 surrounded by raised resisting bevels 92, each of which has a recessive slanted angle and is opposite to and resists a midpoint of every edge on a nut 100 (or a bolt head), for turning the nut 100 (or the bolt head). However, a force to completely screw or unscrew the nut 100 (or the bolt head) is insufficient and fails in driving the nut 100 (or the bolt head) in virtue of restrictive line contacts between the nut 100 (or the bolt head) and the socket 90.

To settle the above problem of a relative slip between the socket and the nut (or the bolt head), an alternative technology (R.O.C Patent No. M323375) as shown in FIG. 2 provides a non-slip socket on which a stable force can be applied forward and reversely: a socket 95 is provided with (a) a hexagon coupling hole 96 which is used to drive a workpiece head 100A (a nut or a bolt head) and (b) rectangular resisting parts 97 axially located at centers of at least three inner walls and contacting all peripheral surfaces of the workpiece head 100A vis-à-vis.

However, the above technology for a non-slip socket driving a nut or a bolt head and minimizing drawbacks such as slippage relative to the nut or the bolt head still has some problems, for instance, the socket 95 needs the rectangular resisting parts 97 axially located at centers of at least three inner walls in order to hold the workpiece head 100A (a nut or bolt head) inside the coupling hole 96 of the socket 95 for exact touches of all contact surfaces which complicate an operation and waste more time; the socket 95 is also taken as an unideal design because the workpiece head 100A with one side bulged or deformed is difficultly or hardly inserted into the socket 95. Furthermore, its deserved to be corrected that the prior art for a non-slip socket which depends on at least three contact surfaces for occlusion may lead to unstable (or shaken) gyration or separation of a workpiece with its workpiece head 100A deformed during application of force. Against this background, it has become a critical issue to correct and get over drawbacks in the prior socket by persons skilled in the industry.

Accordingly, the inventor having considered an imperfect structural design and other drawbacks of the prior art and attempted to optimize a socket with features such as convenient application, stable operation and no excessive waste of nuts or bolt heads has studied and developed the present invention of a driving rotation tool for serving the general public and promoting development of the industry.

SUMMARY OF THE INVENTION

The object of the present invention is to provide a driving rotation tool which is capable of not only normally driving a nut (or a bolt head) but also screwing or unscrewing a workpiece (a nut or a bolt head) with edges or corners worn out or damaged and further promotes overall convenience, economic efficiency and market competitiveness.

The other object of the present invention is to provide a driving rotation tool which is used to conveniently or simply hold a nut or a bolt head, gives a driving force occluding a workpiece, and has superior practicability and market competitiveness.

To reach the above purposes, the present invention is based on technical measures as follows: a socket base; a socket clearance hole being inside the socket base and surrounded by three first gripping surfaces, three second gripping surfaces and six third gripping surfaces for development of edge planes around the socket clearance hole wherein the third gripping surface is located between the first gripping surface and the second gripping surface for circular permutation of first gripping surface, third gripping surface and second gripping surface; the first gripping surface hereinbefore is a cambered surface and the second gripping surface is an angled surface consisting of two adjoining planes which form an obtuse angle greater than 90 degrees.

The present invention is further based on technical measures as follows: a socket base; a socket clearance hole being inside the socket base and surrounded by edge planes comprising more than one first gripping surface and more than one second gripping surface wherein the first gripping surface is a cambered surface, the second gripping surface is an angled surface consisting of two adjoining planes which form an obtuse angle greater than 90 degrees, and at least one of the first gripping surfaces is opposite to the second gripping surface.

For technical features and effects in terms of the present disclosure completely understood and recognized, the preferred embodiments and detailed drawings are described hereinafter.

DETAILED DESCRIPTION OF THE PREFERRED EMBODIMENTS

Figure 1:
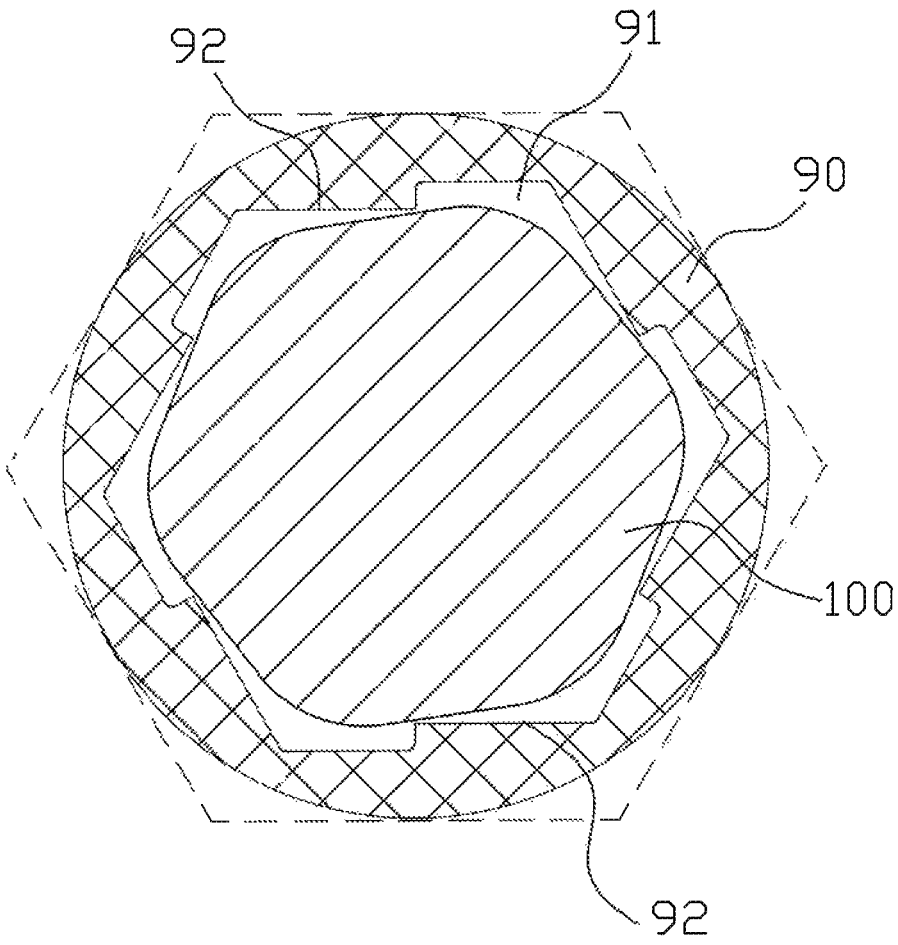
FIG. 1 ( Prior Art )
FIG. 1 is a first schematic view of a socket based on a prior art.
Figure 2:
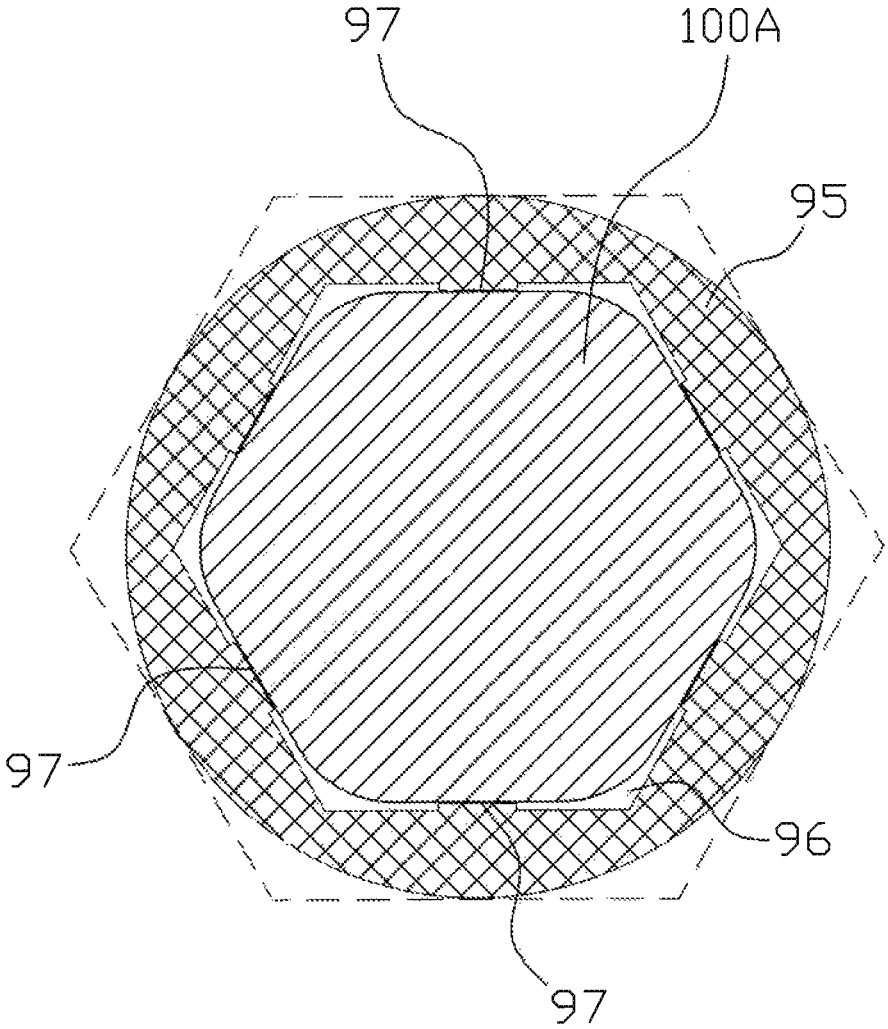
FIG. 2 ( Prior Art )
FIG. 2 is a second schematic view of a socket based on another prior art.
Figure 3:
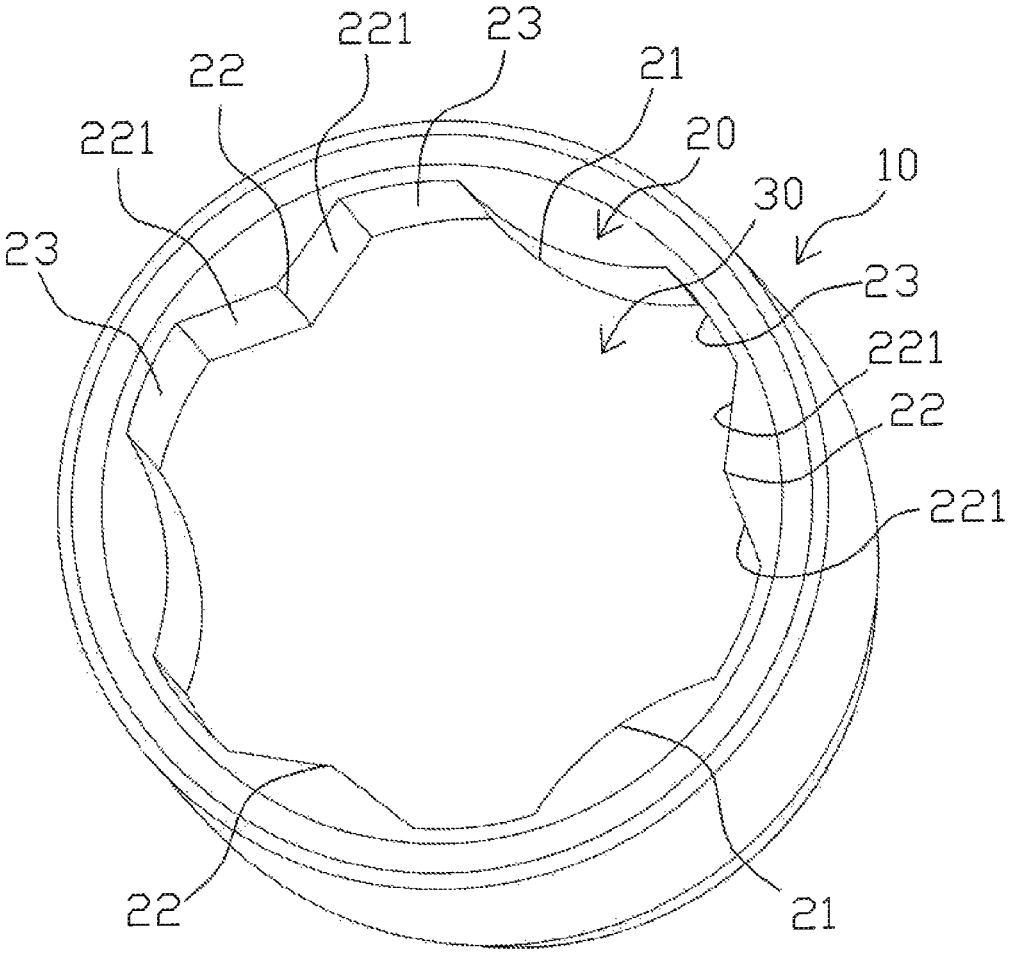
FIG. 3 is a schematic perspective view of the present invention in a first embodiment.
Figure 4:
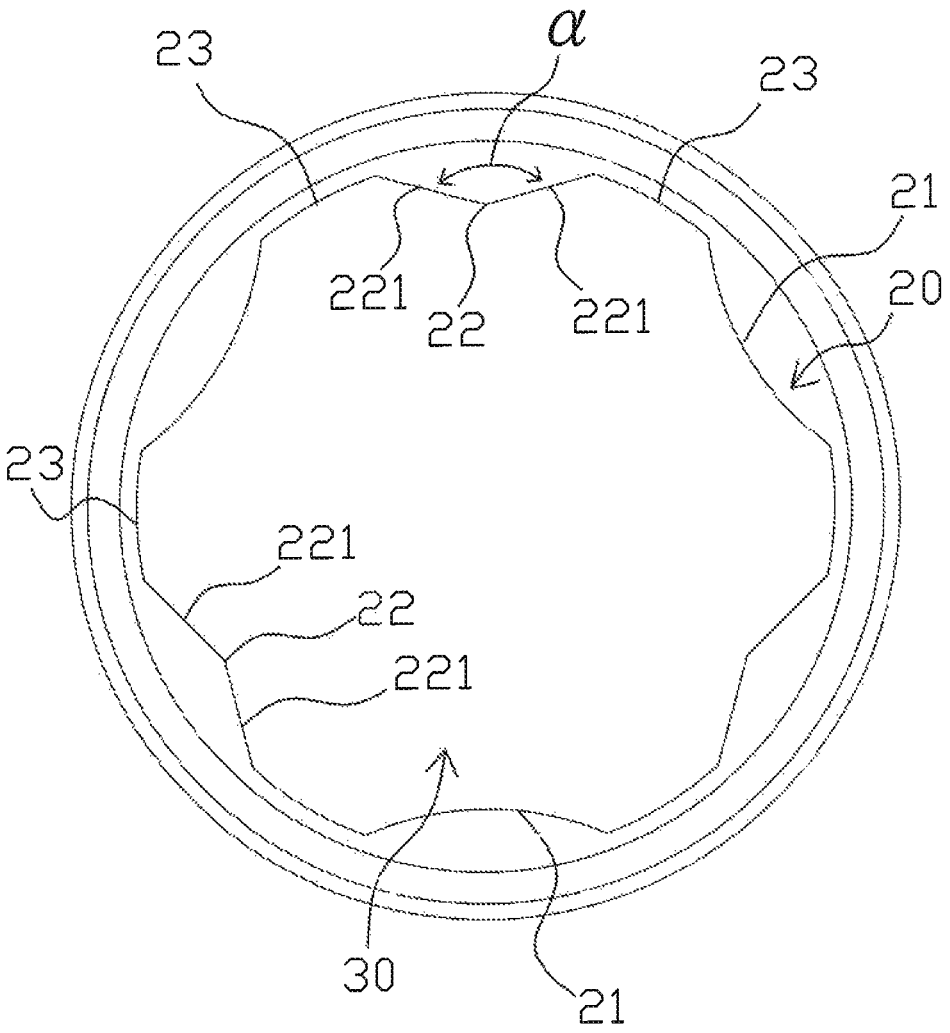
FIG. 4 is a top view of the present invention.

Referring to FIGS. 3 and 4 which illustrate the present invention of a driving rotation tool in a first embodiment is applicable to a wrench, a socket (disclosed in an embodiment hereinafter) or other gyration tools in general. As shown in FIGS. 3 and 4, the present invention of a driving rotation tool comprises: a socket 10; a socket base 20 inside the socket 10; a socket clearance hole 30 (i.e., a through hole disclosed in this embodiment or a recess hole) centrally opened at the socket base 20. The socket base 20 comprises a plurality of first gripping surfaces 21, second gripping surfaces 22 and third gripping surfaces 23 which constitute edge planes of the socket clearance hole 30 wherein the third gripping surface 23 is located between the first gripping surface 21 and the second gripping surface 22 for circular permutation of first gripping surface 21, third gripping surface 23, second gripping surface 22, first gripping surface 21, third gripping surface 23, second gripping surface 22, and so on. In this embodiment, there are totally three first gripping surfaces 21, three second gripping surfaces 22 and six third gripping surfaces 23.

The first gripping surface 21 is a cambered surface; the second gripping surface 22 is an angled surface consisting of two adjoining planes 221, both of which form an a angle (FIG. 4), i.e., an obtuse angle greater than 90 degrees, and are contiguous to third gripping surfaces 23 at both sides of the second gripping surface 22; the third gripping surface 23 is a cambered surface in this embodiment or a straight plane.

Among the above edge planes permuted around the socket clearance hole 30, the first gripping surface 21 is opposite to the second gripping surface 22, that is, an opposite plane of the first gripping surface 21 is the second gripping surface 22; the third gripping surface 23 is opposite to the other third gripping surface 23, that is, an opposite plane of the third gripping surface 23 is exactly the other same third gripping surface 23.

Figure 5:
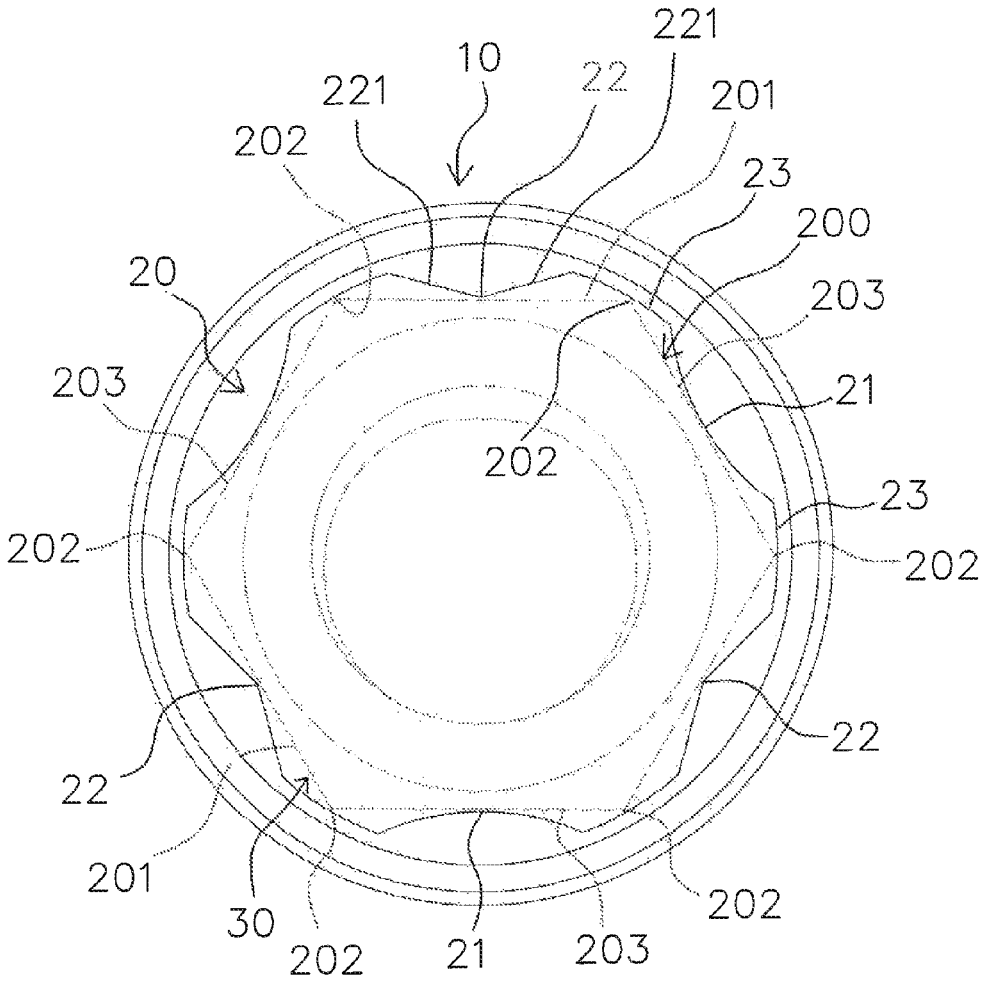
FIG. 5 is a first schematic view of a first application embodiment of the present invention.

Referring to FIG. 5 which illustrates the first application embodiment of the present invention, a hexagon nut 200 (or a bolt head) with six block corners 202 and six end planes consisting of three edge planes 201 and three edge planes 203 is inserted into the socket clearance hole 30 of the socket 10: the edge plane 201 is contiguous to the edge plane 203; the edge plane 201 of the nut 200 resists the second gripping surface 22; the edge plane 203 of the nut 200 resists the first gripping surface 21; each of the six block corners 202 of the nut 200 is opposite to and resists (or does not resist) the third gripping surface 23. In this embodiment, the three edge planes 201 and the three edge planes 203 resist the second gripping surfaces 22 and the first gripping surfaces 21, respectively. During operation, a force is applied on the socket 10 and used to turn (screw or unscrew) the nut 200 for development of different force application points based on a plurality of line contacts when the edge planes 201 and the edge planes 203 on the nut 200 contact with the second gripping surfaces 22 and the first gripping surfaces 21, respectively.

Figure 6:
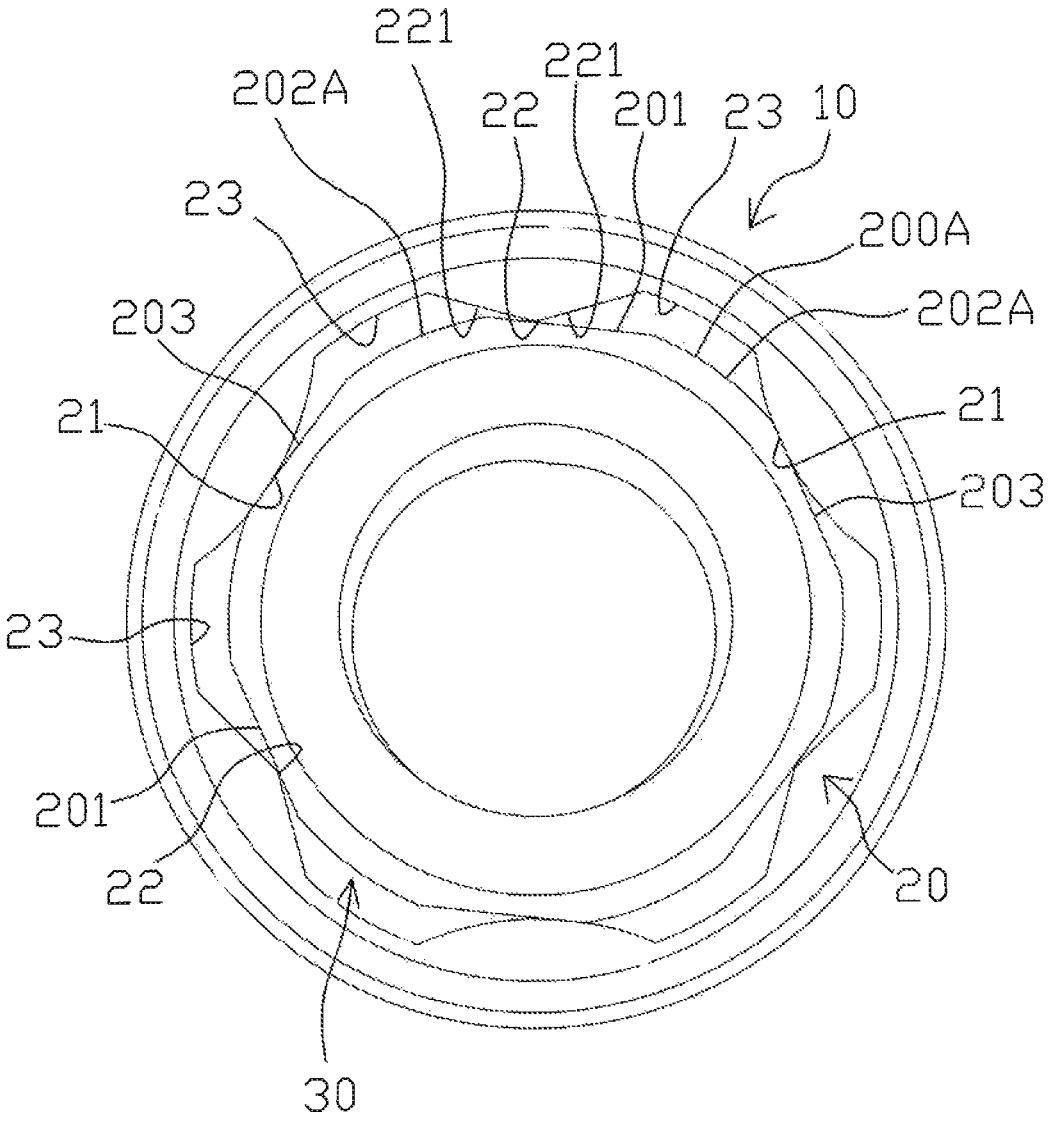
FIG. 6 is a second schematic view of a second application embodiment of the present invention.

Referring to FIG. 6 which illustrates the second application embodiment for the present invention, the socket 10 allows the nut 200A (or a bolt head) to be held in the socket clearance hole 30 wherein the nut 200A has six block corners 202A worn out or damaged after long-term usage as well as six end planes including three edge planes 201 and three edge planes 203: the edge plane 201 is contiguous to the edge plane 203; the edge plane 201 resists the second gripping surface 22; the edge plane 203 resists the first gripping surface 21; the six block corners 202A of the nut 200A are opposite to and do not resist the third gripping surfaces 23. During operation, a force is applied on the socket 10 and used to turn (screw or unscrew) the nut 200A for development of different force application points based on a plurality of line contacts when the edge planes 201 and the edge planes 203 on the nut 200A contact with the second gripping surfaces 22 and the first gripping surfaces 21, respectively; that is, the present invention has a structural design which is still capable of screwing or unscrewing the nut 200A (or a bolt head) with its block corners 202A worn out or damaged.

Figure 7:
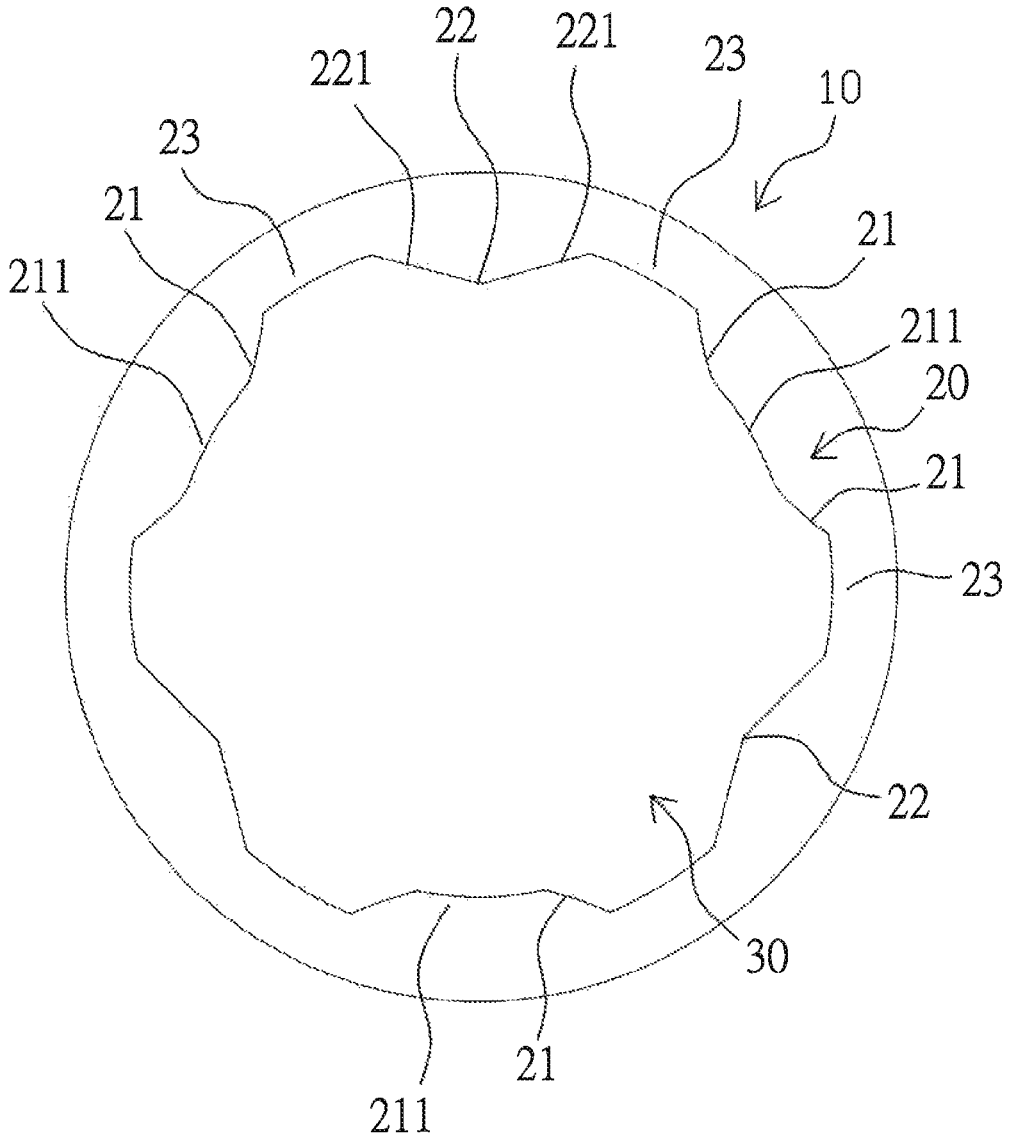
FIG. 7 is a top view of the present invention in a second embodiment.

Referring to FIG. 7 which illustrates the present invention of a driving rotation tool in a second embodiment with alternative design differentiated from the first one and shown as follows: the first gripping surface 21 of the socket base 20 comprises at least an intrados 211 in place whose contour is reversely held in the cambered surface of the first gripping surface 21. As shown in FIG. 7, the cambered surface of the first gripping surface 21 is raised inward but the intrados 211 outward. As such, the present invention allows a nut or a bolt head (not shown in FIG. 7) which is held in the socket clearance hole 30 to properly and peripherally contact the intrados 211 and generates a superior gyratory force used in operatively screwing/unscrewing the nut or the bolt head.

It can be seen from above descriptions that the present invention of a driving rotation tool facilitates not only normally driving a nut (or a bolt head) but also screwing or unscrewing a workpiece (a nut or a bolt head) with edges or corners worn out or damaged and further promotes overall convenience and economic efficiency. Furthermore, the present invention which is used to conveniently or simply hold a nut or a bolt head gives a driving force occluding a workpiece and has superior practicability and market competitiveness.

Therefore, the present invention significantly meets patentability and is applied for the patent. However, the above descriptions present preferred embodiments only which do not limit the scope of the present invention; any equivalent change or improvement based on shapes, structures, features and spirit mentioned in the present invention should be incorporated in claims of the present invention.

What is claimed is:

1. A driving rotation tool, comprising:

a socket base;

a socket clearance hole being in said socket base and surrounded by three first gripping surfaces, three second gripping surfaces and six third gripping surfaces for development of edge planes around said socket clearance hole wherein each third gripping surface is located between a first gripping surface and a second gripping surface for circular permutation of first gripping surface, third gripping surface and second gripping surface;

each first gripping surface is a cambered surface, each second gripping surface is an angled surface consisting of two adjoining planes which form an obtuse angle greater than 90 degrees, wherein a surface area of the first gripping surface is larger than a surface area of the third gripping surface, wherein a surface area of the second gripping surface is larger than a surface area of the third gripping surface, and wherein each first gripping surface comprises at least an intrados on its cambered surface in place.

2. The driving rotation tool according to claim 1 wherein said socket clearance hole is a through hole or a recess hole.

3. The driving rotation tool according to claim 1 wherein each third gripping surface in said socket base is a cambered surface or a straight plane.

4. The driving rotation tool according to claim 1 wherein each first gripping surface is opposite to a second gripping surface.

5. The driving rotation tool according to claim 4 wherein each third gripping surface is opposite to one another third gripping surface.

6. The driving rotation tool according to claim 1 wherein said socket base can be integrated with a wrench, a socket or other gyration tools.

7. The driving rotation tool according to claim 1 wherein said intrados has a contour reversely held in a first gripping surface's cambered surface.

* * * * *